United States Patent [19]

Marcum et al.

[11] Patent Number: 4,917,832

[45] Date of Patent: Apr. 17, 1990

[54] AIR LIFT DIFFUSER

[75] Inventors: Thomas J. Marcum, Englewood; Troy W. Fieselman, Littleton; Richard B. Weber, Denver, all of Colo.

[73] Assignee: Wilfley Weber, Inc., Englewood, Colo.

[21] Appl. No.: 310,061

[22] Filed: Feb. 10, 1989

[51] Int. Cl.[4] ..... B01F 3/04

[52] U.S. Cl. ..... 261/77; 261/120; 261/122

[58] Field of Search ..... 261/77, 122, 120

[56] References Cited

U.S. PATENT DOCUMENTS

| | | | |
|---|---|---|---|
| 3,371,779 | 3/1968 | Hollingsworth et al. | 261/122 |
| 3,758,277 | 9/1973 | Cook et al. | 261/77 |
| 3,852,384 | 12/1974 | Bearden | 261/77 |
| 3,910,826 | 10/1975 | Kataoka | 261/77 |
| 3,969,446 | 7/1976 | Franklin, Jr. | 261/77 |
| 4,051,035 | 9/1977 | Boschen et al. | 261/77 |
| 4,070,423 | 1/1978 | Pierce | 261/77 |
| 4,358,413 | 11/1982 | Brucker | 261/120 |
| 4,549,997 | 10/1985 | Verner et al. | 261/77 |

FOREIGN PATENT DOCUMENTS 2502660 8/1975 Fed. Rep. of Germany ..... 261/77

OTHER PUBLICATIONS

Copco, Limno Hypolimnion Aerator, Atlas Copco AB, 5-105 23 Stockholm, Sweden.

*Primary Examiner*—Tim Miles

*Attorney, Agent, or Firm*—Clement and Ryan

[57] ABSTRACT

An air lift diffuser for use in the aeration of a body of water including an air lift tube and a gas diffuser located a distance below the open bottom end of the air lift tube. The distance in question is sufficiently large that there is substantially no obstruction to the passage of water from the space surrounding the air lift diffuser into the space between the air lift tube and the diffuser, but at the same time is not so large that rising air bubbles are likely to escape and flow outside the air lift tube. In one embodiment, a cylindrical return tube is provided around the air lift tube that directs the water stream and gas bubbles entrained therein downward, after they have risen in the air lift tube, so as to return the aerated water to the lower levels of the body of water being aerated.

9 Claims, 1 Drawing Sheet

FIG. 1
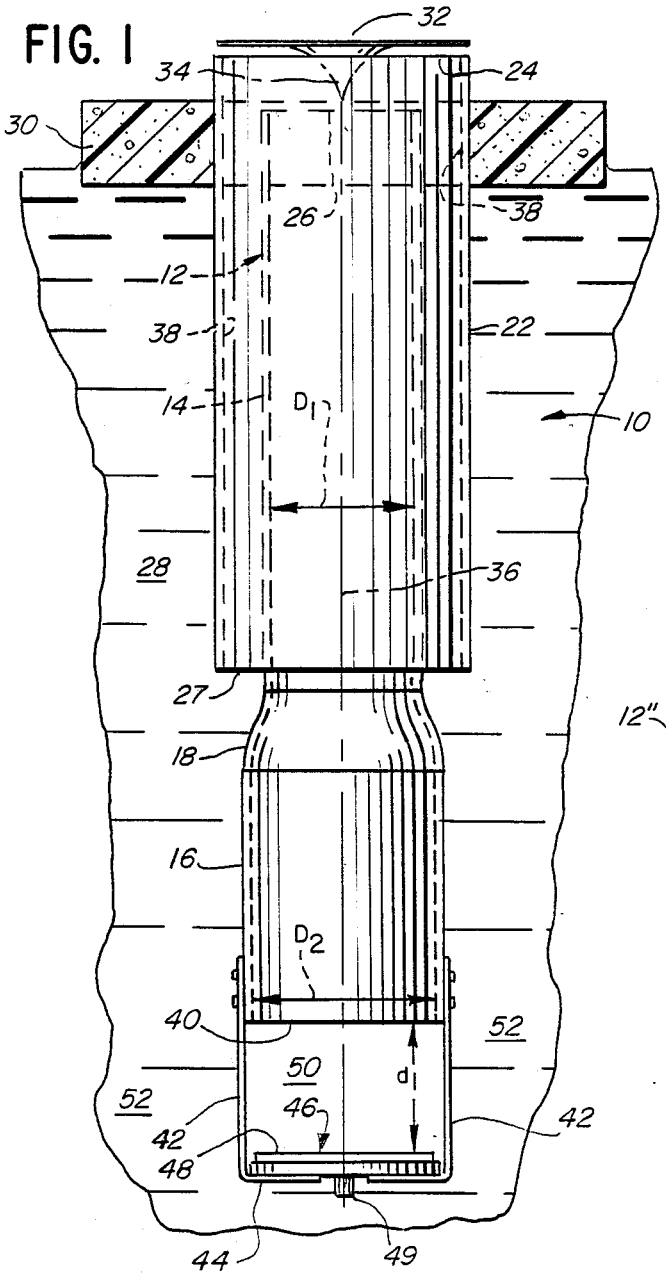
FIG. 5
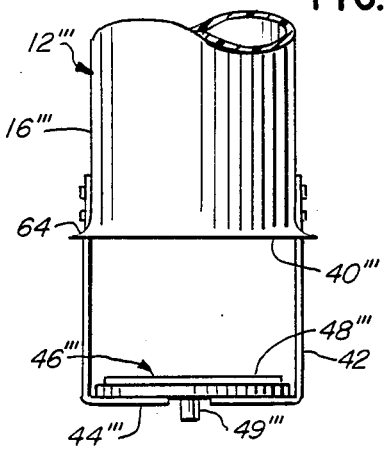
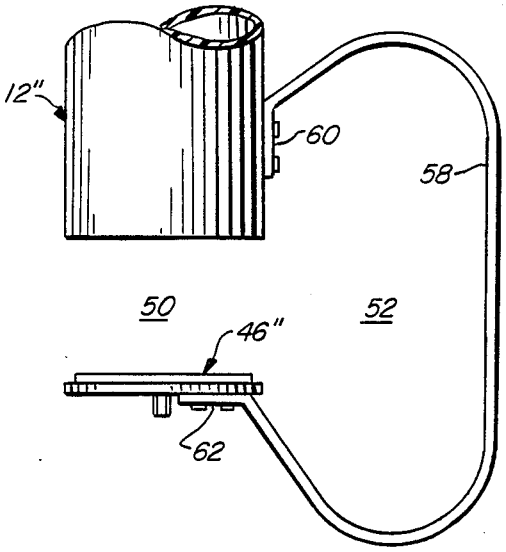
FIG. 4
FIG. 2
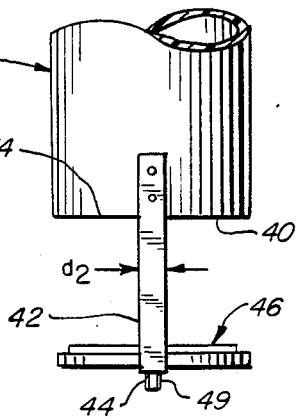
FIG. 3
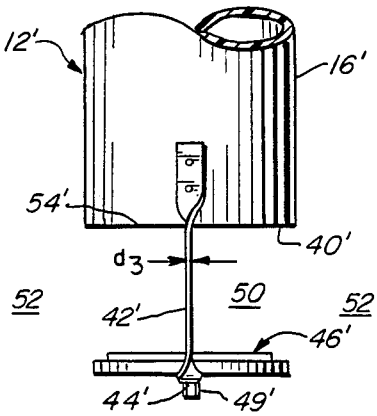

AIR LIFT DIFFUSER

This invention relates to an improved air lift pump using a gas diffuser or, in other words, an improved air lift diffuser, which is useful in the aeration of a body of water through the introduction of diffused air bubbles into the water.

BACKGROUND OF THE INVENTION

Basic air lift pumps and diffusers for the introduction of either coarse, medium or fine gas bubbles into a body of water have been known for a great many years. In actual fact, air lift pumps have been available for almost two centuries, and gas diffusers of one type or another have been known for at least as long. These two well known devices have likewise been combined for many years to form air lift diffusers for use in the aeration of a body of water, but none of these combinations have been as effective as was expected.

Various efforts have been made, for example, to increase the pumping capacity of the rising column of water and entrained air bubbles in the air lift tube, by the introduction of impellers or other devices located in the air lift tube. Improvements have also been available for at least the past 10 years that are designed to break up coarse bubbles in the air lift tube to gain high transfer efficiencies.

However, the benefits of providing unobstructed paths (neither too small nor too large) both for the water entering at the bottom of the air lift diffuser from the body of water being aerated, and for the rising column of water and air bubbles below and within that tube have prior to the present invention not been recognized.

Nor, apparently because it was desired to take advantage of the more rapidly rising coarse bubbles, have the benefits of employing fine gas bubbles in an air lift diffuser been recognized, even though various types of diffusers that emit fine gas bubbles have been known for several decades. These known air lift diffusers that utilize coarse gas bubbles require a larger volume of gas flow to lift a given volume of water, and produce a lower volume of absorption of oxygen into the pumped water, than is the case with the present invention.

SUMMARY OF THE INVENTION

This invention comprises:

(a) a cylindrical air lift tube the interior of which is substantially open and substantially free of any obstruction throughout its length;

(b) a gas diffuser, having a circular, horizontally oriented, fixed bubble emitting surface the diameter of which is approximately equal to the internal diameter of the open bottom end of the air lift tube; and (c) members supporting the gas diffuser a substantial distance below the air lift tube.

Satisfactory results are obtained when the latter distance is equal to about ½ to about 1½ times the internal diameter of the open bottom end of the air lift tube. Improved results are obtained when the distance is equal to about ½ to about 1 times that air lift tube diameter. A distance of about ⅔ times that air lift tube diameter is preferred.

The space immediately surrounding the space between the air lift tube and the gas diffuser is substantially open and substantially free of any obstruction to the passage of water from that surrounding space into the space between the air lift tube and the diffuser. The space between the bubble emitting surface of the gas diffuser and the bottom end of the air lift tube is likewise substantially open and substantially free of any obstruction to the passage of bubbles from the gas diffuser into the open bottom end of the air lift tube.

In a preferred embodiment, the vertical midportion of the air lift tube has a reduced internal diameter as: one moves in the upward direction, which results in an increased velocity for the rising stream of water and entrained bubbles in the upper portion of the air lift tube.

In another preferred embodiment, a cylindrical return tube is provided (at the top of the air lift diffuser) that surrounds the air lift and is concentric with it, with the open top end of the return tube extending above the open top of the air lift tube, and the bottom end of the return tube extending to a point located between the top quarter of the air lift tube and the vicinity of the bottom end portion of the air lift tube.

If desired, a circular deflector plate can be positioned above the air lift tube, which plate includes curved guide surfaces that direct portions of the water stream and gas bubbles entrained therein radially outward from the central axis of the air lift tube toward the surrounding walls of the return tube. The return tube and deflector plate thus operate to return aerated water to the lower levels of the body of water being aerated.

The deflector plate just described can be used with the air lift diffuser of this invention whether or not a return tube is employed. If no return tube is included in the air lift diffuser, the deflector plate directs the aerated water that rises in the air lift tube outward at the upper levels of the body of water being aerated.

The air lift diffuser of this invention with an air lift tube having a uniform internal diameter produces the greatest pumping capacity (as defined below in this specification). The air lift diffuser of this invention in which the air lift tube has a necked-down midportion produces the greatest mixing capacity, because of the higher velocity that results from the reduction of the internal diameter of the air lift tube at its midportion.

Either of these forms of the air lift diffuser will "turn" the body of water by moving the water from the bottom levels to the top levels, and vice versa; in other words, if the body of water is stratified, it will be destratified by mixing water from the various levels occupied by the water. Use of the air lift diffuser of this invention including a return tube as described above will aerate the bottom waters of a lake, for example, without "turning" the lake; in other words, the lake will not be destratified by use of this embodiment.

BRIEF DESCRIPTION OF THE DRAWING

The invention will now be described in more detail by reference to the accompanying drawing, in which:

FIG. 1 is a side elevation of one embodiment of this invention located in place in a body of water being aerated.

FIG. 2 is a fragmentary side elevation of the same embodiment of the air lift diffuser, as viewed from the right-hand side of FIG. 1.

FIG. 3 is a fragmentary side elevation of another embodiment of the air lift diffuser of this invention.

FIG. 4 is a fragmentary side elevation of a further embodiment of the air lift diffuser of this invention.

FIG. 5 is a fragmentary side elevation of still another embodiment of the air lift diffuser of this invention.

DETAILED DESCRIPTION OF PREFERRED EMBODIMENTS

FIG. 1 is a side elevation of air lift diffuser 10, which is one embodiment of the diffuser of this invention.

Air lift tube 12, open at its top and bottom ends, includes upper portion 14 which is a straight cylindrical portion of internal diameter $D_1$, and lower, straight cylindrical portion 16 of internal diameter $D_2$, which is larger than diameter $D_1$. Vertical midportion 18, which has a gradually reduced internal diameter moving in the upward direction, connects the upper and lower portions 14, 16.

As pointed out above, this construction of the air lift tube results in an increased velocity for the rising stream of water and entrained bubbles, and as a result greater mixing, in the upper portion of the air lift tube. As also pointed out above, if necked-down midportion 18 is not included in the air lift diffuser, the pumping capacity of the device will be larger.

Air lift tube 12 may be formed of any suitable material such as, for example, polyvinyl chloride.

It is preferred that tube 12 have a circular transverse cross section throughout its length. The interior of tube 12 is substantially open and substantially free of any obstruction throughout its length.

The tube may be of any desired length, depending upon the depth of the body of water that is to be aerated. The longer the air lift tube, the greater the pumping capacity of the air lift diffuser will be.

Cylindrical return tube 22, having an internal diameter substantially larger than the outside diameter of air lift tube 12, is included in the preferred form of this invention. Tube 22, which may be formed of any suitable material such as polyvinyl chloride, surrounds air lift tube 12 and is concentric with it. Return tube 22 has an open top end that extends above the open top end 26 of air lift tube 12. Its bottom end 27 extends to a point located between the midportion of air lift tube 12 and the vicinity of the bottom end of the air lift tube.

If desired, bottom end 27 of return tube 22 may extend to within a foot or so of bottom end 40 of air lift tube 12. With return tube 22, all the water that is pumped up through air lift tube 12 is discharged as an aerated fluid from the bottom of the return tube.

In the embodiment illustrated in FIG. 1, the air lift tube and the return tube are supported in body of water 28 by float 30, with float 30 secured to return tube 22, and that member in turn secured to air lift tube 12, both by any suitable means (not shown). Float 30 maintains air lift diffuser 10 in a vertical position within the body of water being aerated. At its bottom end, the device is anchored by any suitable means (not shown) to the bottom of the pond or other container in which the body of water being aerated is located.

In certain embodiments of this air lift diffuser, a base formed of some dense material such as concrete is provided, and the entire air lift diffuser is anchored to, and supported by, that base. Any other suitable means of securely positioning the air lift diffuser in the body of water being aerated may be used.

It is further preferred that the air lift diffuser of this invention include a circular deflector plate 32 positioned above the air lift tube, and attached to that tube by any suitable means (not shown). The deflector plate includes curved guide surfaces 34 to direct portions of the stream of water and gas bubbles entrained therein that rise in air lift tube 12 radially outward from central axis 36 of the air lift tube toward the surrounding walls 38 of return tube 22.

At the open bottom end 40 of air lift tube 12, straps 42 are attached by any suitable means to bottom portion 16 of the tube. These straps turn inward at their bottom ends 44 to support gas diffuser 46 below air lift tube 12. Diffuser 46 has a circular, horizontally oriented, bubble emitting surface 48, which has a diameter approximately equal to internal diameter $D_2$ of open bottom end 40 of air lift tube 12. As shown, feed line 49 delivers air under pressure to gas diffuser 46. Bubble emitting surface 48 has a fixed, non-rotating position with respect to the rest of the air lift diffuser.

In the preferred embodiment shown in FIG. 1, gas diffuser 46 emits fine gas bubbles. For purposes of this specification and the appended claims, fine gas bubbles are defined as those that are approximately 2–4 mm. in diameter, medium gas bubbles are considered those of 4–9 mm. diameter, and coarse gas bubbles are considered to be those of 10 mm. diameter and over. These sizes are consistent with the conventional definitions of fine, medium and coarse gas bubbles that are used in the water and waste water treatment industry.

The preferred embodiment of the air lift diffuser of this invention employs a gas diffuser adapted to produce fine gas bubbles of good uniformity in size. Such an air lift diffuser provides a two-to-threefold improvement in pumping capacity (measured in terms of cubic feet of water pumped per minute divided by the number of standard cubic feet of air supplied per minute) and a gain of 20 percent or more in oxygen transfer efficiency (i.e., quantity of oxygen absorbed by the water expressed as a percentage of the quantity of oxygen supplied) in comparison to known air lift diffusers utilizing coarse bubble gas diffusers.

Moreover, it has been found that with a carefully selected fine gas bubble diffuser, the bubbles do not coalesce to form larger bubbles as they rise in air lift tube 12. In addition, these uniform size bubbles are evenly distributed across and throughout air lift tube 12, substantially filling the tube as they rise.

In the embodiment of FIG. 1, straps 42 support gas diffuser 46 with its bubble emitting surface 48 spaced from open bottom end 40 of the air lift tube by a vertical distance $d_1$. Distance $d_1$ is selected to be large enough that it will produce minimal resistance to the pumped liquid moving from space 52 that is located around the air lift diffuser into space 50 between open bottom end 40 of air lift tube 12 and gas diffuser 46, where it is infused with rising air bubbles so that it will pass upward into the air lift tube. At the same time, distance $d_1$ is selected to be not so large that it will tend to permit air bubbles rising from gas diffuser 46 to escape being collected by open bottom end 40 of the air lift tube.

Good results are ordinarily obtained when distance $d_1$ is between about $\frac{1}{2}$ to about $1\frac{1}{2}$ times internal diameter $D_2$ of open bottom end 40 of the air lift tube, improved results are obtained when distance $d_1$ is about $\frac{1}{2}$ to about 1 times internal diameter $D_2$, and best results are obtained when distance $d_1$ is equal to about $\frac{2}{3}$ times diameter $D_2$. If the air lift diffuser is to be used to aerate a body of water that is likely to exhibit some movement unrelated to the aeration process, a ratio at the low end of the indicated range should be selected. In the embodiment illustrated in FIG. 1, the ratio in question is a little over $\frac{2}{3}$.

Prior workers in this field have assumed that if the bubble emitting surface of the gas diffuser of an air lift diffuser was located at as great a distance from the air lift tube as even the minimum distance just indicated, there would be substantial impairment of the effectiveness of the air lift diffuser because the gas bubbles would tend to escape outward from the space between the gas diffuser and the air lift tube rather than to flow directly upward into the air lift tube. Surprisingly, it has been discovered that this is not true, and that it actually improves the performance of the air lift diffuser if a substantial space is left, of the magnitude indicated, between the open bottom end of the air lift tube and the bubble emitting surface of the gas diffuser. Apparently a space of the size indicated, which is large enough but not too large, will permit the water in space 52 immediately surrounding space 50 between air lift tube and gas diffuser 46 easy access to the space above the gas diffuser, from whence it will flow readily, with the air bubbles entrained in the stream of water, into the air lift tube.

It is important that space 50 between bubble emitting surface 48 of gas diffuser 46 and bottom end 40 of air lift tube 12 be substantially open and substantially free of any obstruction to the passage of bubbles from the gas diffuser into the open bottom end of the air lift tube. Prior workers in this field have assumed that it was acceptable, and even desirable, to insert in this space, as well as in the interior of the air lift tube, various devices such as impellers or fingers to attempt to decrease the size of entrained bubbles in the tube, and otherwise to improve the effectiveness of the air lift diffuser. It has been found, however, that better results are obtained when this space is kept wholly open and free of any obstruction.

To bring this about, space 52 around air lift diffuser 10 is maintained substantially open and substantially free of any obstruction to the passage of water from that space into space 50 between the air lift tube and the gas diffuser. For this reason, in the embodiment illustrated in FIGS. 1 and 2 each of the plurality of support members 42 that secures gas diffuser 46 to air lift tube 12 has a dimension $d_2$, along substantially its entire length, measured parallel to circumference 54 of open bottom end 40 of tube 12 that is relatively small in comparison to that circumference.

FIG. 3 is a fragmentary side elevation of another embodiment of the air lift diffuser of this invention, showing only the bottom portion thereof. In this embodiment, straps 42', supporting gas diffuser 46 are twisted 90° in the portion of the straps extending between open bottom end 40 of bottom portion 16' of air lift tube 12' and gas diffuser 46'. This has reduced dimension $d_3$ of straps 42' (measured parallel to circumference 54 of open bottom 40) to a still smaller fraction of that circumference. Accordingly, there is still less obstruction to the free flow of water into space 50 between bottom end 40' of air lift tube 12' and gas diffuser 46' from space 52 immediately surrounding space 50.

The bubble emitting surface of gas diffuser 46' has a fixed, non-rotating position with respect to the rest of the air lift diffuser.

FIG. 4 is a fragmentary side elevation showing the bottom portion of a further embodiment of the air lift diffuser of this invention. In this embodiment, bracket 58 is attached at its upper end 60 to air lift tube 12'', and at its lower end 62 to gas diffuser 46''. Bracket 58 is formed of any suitable rod or strap, and is positioned well outside space 52 that immediately surrounds space 50 between open bottom end 40'' of the air lift tube and the gas diffuser. With this embodiment, any obstruction to the free passage of liquid from space 52 into space 50 has been wholly eliminated. The bubble emitting surface of gas diffuser 46'' has a fixed, non-rotating position with respect to the rest of the air lift diffuser.

FIG. 5 is fragmentary side elevation of still another embodiment of the air lift diffuser of this invention, showing the bottom portion thereof. In this embodiment, bottom portion 16''' of air lift tube 12''' flares outward at its extreme bottom end, at outwardly extending flange 64. This outward flare is employed in an abundance of caution, to ensure that any stray gas bubbles tending to flow outward after rising from bubble emitting surface 48''' of gas diffuser 46''' will be corralled and led into open bottom end 40''' of the air lift tube. The bubble emitting surface of gas diffuser 46''' has a fixed, non-rotating position with respect to the rest of the air lift diffuser.

While the present invention has been described above, and illustrated in the accompanying drawing, in connection with the best mode presently contemplated by the inventors for carrying out their invention, the preferred embodiments described and shown are for purposes of illustration only, and are not to be construed as constituting any limitation of the invention. Modifications will be obvious to those skilled in the art, and all modifications that do not depart from the spirit of the invention are intended to be included within the scope of the appended claims.

We claim:

1. An air lift diffuser for aerating a body of water which comprises:

(a) an air lift tube open at its top and bottom ends, said tube being adapted to be supported in a vertical position in said body of water and having a circular transverse cross section and having a predetermined internal diameter at its open bottom end, the interior of said tube being substantially open and substantially free of any obstruction throughout its length;

(b) means for supporting said air lift tube in said vertical position in said body of water;

(c) a gas diffuser adapted to be positioned below said air lift tube, said gas diffuser having a circular, horizontally oriented, fixed non-rotating bubble emitting surface the diameter of which is approximately equal to the internal diameter of the open bottom end of said air lift tube; and (d) means for supporting said gas diffuser with the bubble emitting surface of the gas diffuser spaced from the open bottom end of the air lift tube a distance equal to approximately ½ to approximately 1½ times the internal diameter of the open bottom end of said air lift tube, the space between the bubble emitting surface of the gas diffuser and the bottom end of the air lift tube being substantially open and substantially free of any obstruction to the passage of bubbles from the gas diffuser into the open bottom end of the air lift tube, and the space immediately surrounding the space between said air lift tube and said gas diffuser being substantially open and substantially free of any obstruction to the passage of water from said surrounding space into the space between said two members.

2. The air lift diffuser of claim 1 in which the bubble emitting surface of said gas diffuser is spaced below the open bottom end of the air lift tube a distance equal to approximately ½ to approximately 1 times said predetermined diameter of said air lift tube.

3. The air lift diffuser of claim 1 in which the bubble emitting surface of said gas diffuser is spaced below the open bottom end of said air lift tube a distance equal to approximately ⅔ times said predetermined diameter of the air lift tube.

4. The air lift diffuser of any of claims 1–3 in which the bottom end portion of said air lift tube is outwardly flared.

5. The air lift tube of any of claims 1–3 which includes a plurality of support members secured to the air lift tube for supporting said gas diffuser, each of said support members having a dimension, along substantially its entire length, measured parallel to the circumference of said tube that is relatively small in comparison to said circumference.

6. The air lift diffuser of any of claims 1–3 in which the bottom portion of said air lift tube has a first uniform internal diameter, the vertical midportion of said tube has a gradually reduced internal diameter moving in the upward direction, and the upper portion of the tube has a second uniform internal diameter smaller than said first diameter.

7. The air lift diffuser of any of claims 1–3 which includes a cylindrical return tube open at its top and bottom ends, said return tube having an internal diameter substantially larger than the outside diameter of the air lift tube and being concentric with but shorter than the air lift tube, the open top end of said return tube extending above the open top end of the air lift tube, with the bottom end of the return tube extending to a point located between the top quarter of the air lift tube and the vicinity of the bottom end portion of the air lift tube.

8. The air lift diffuser of any of claims 1–3 which includes a circular deflector plate positioned above said air lift tube, said deflector plate including curved guide surfaces to direct portions of the stream of water and gas bubbles entrained therein radially outward from the central axis of the air lift tube toward the surrounding walls of said return tube.

9. The air lift diffuser of any of claims 1–3 in which said gas diffuser is adapted to emit fine gas bubbles.

* * * * *